US007730941B2

(12) United States Patent
Abarca et al.

(10) Patent No.: US 7,730,941 B2
(45) Date of Patent: Jun. 8, 2010

(54) EXPANDABLE TOOL WITH ENHANCED EXPANSION CAPABILITY

(75) Inventors: John R. Abarca, Houston, TX (US); Shawn E. Nowlin, Conroe, TX (US); Dorothy L. Nowlin, legal representative, Conroe, TX (US)

(73) Assignee: Baker Hughes Incorporated, Houston, TX (US)

( * ) Notice: Subject to any disclaimer, the term of this patent is extended or adjusted under 35 U.S.C. 154(b) by 310 days.

(21) Appl. No.: 11/138,528

(22) Filed: May 26, 2005

(65) Prior Publication Data

US 2006/0266514 A1 Nov. 30, 2006

(51) Int. Cl.
*E21B 23/00* (2006.01)

(52) U.S. Cl. ..... 166/207; 166/195

(58) Field of Classification Search ..... 166/277, 166/384, 207, 217, 242.2, 195
See application file for complete search history.

(56) References Cited

U.S. PATENT DOCUMENTS

| | | | | |
|---|---|---|---|---|
| 6,203,020 | B1 | 3/2001 | Mireles, Jr. et al. | |
| 6,530,574 | B1 | 3/2003 | Bailey et al. | |
| 6,622,789 | B1 | 9/2003 | Braddick | |
| 7,077,214 | B2 * | 7/2006 | Vincent et al. | 166/387 |
| 7,134,504 | B2 | 11/2006 | Doane et al. | |
| 7,341,110 | B2 | 3/2008 | Doane et al. | |
| 7,493,945 | B2 | 2/2009 | Doane et al. | |
| 2002/0092657 | A1 * | 7/2002 | Cook et al. | 166/382 |
| 2003/0102127 | A1 | 6/2003 | Braddick | |
| 2005/0023003 | A1 * | 2/2005 | Echols et al. | 166/384 |

OTHER PUBLICATIONS

Walkevar, S., et al., "Expandable Technology Improves Reliability of Conventional Liner Hanger Systems", IASC/SPE 99186, Feb. 2006, 1-11.

Klevelaan, M., et al., "Deplolyment of Swelling Elastomer Packers in Shell E & P", SPE/IADC 92346, Feb. 2005, 1-5.

Chustz, M., et al., "Expandable Liner Installation Avoids Sidetracking Following Production Casing Failure in the Gulf of Mexico," SPE/ IADC 91923, Feb. 2005, 1-7.

* cited by examiner

*Primary Examiner*—Jennifer H Gay
*Assistant Examiner*—Robert E Fuller
(74) *Attorney, Agent, or Firm*—Steve Rosenblatt

(57) ABSTRACT

An expandable downhole tool features a mandrel that is expanded from within by a swage or other technique. The expansion of the mandrel advances an exterior ring or comparable slidably mounted object against an exterior sleeve that can be impervious or porous. The ring engages a ratchet mechanism to hold its position with respect to the mandrel as the swage advances through the mandrel and expands the ring and the exterior sleeve. The locking of the ring to the mandrel keeps the exterior sleeve from springing back longitudinally as the expansion is concluded.

12 Claims, 2 Drawing Sheets

EXPANDABLE TOOL WITH ENHANCED EXPANSION CAPABILITY

FIELD OF THE INVENTION

The field of this invention relates to expandable downhole tools and more particularly to such tools with enhanced exterior features for bridging an annular gap around the tool.

BACKGROUND OF THE INVENTION

In the past in the context of downhole tools that employ expansion to seal an annular gap around its mandrel the degree of sealing contact of a resilient sleeve mounted to the mandrel with the surrounding wellbore could be controlled in two ways. One way was the degree of expansion from within the mandrel afforded by the swage being employed. Another way was to simply alter the thickness of the sleeve mounted to the mandrel. For a given borehole size, a thicker resilient sleeve resulted in a tighter seal of the sleeve against the surrounding borehole for a given amount of mandrel expansion with a swage. A given size pipe had limits on how much it could be expanded. On the other hand keeping many versions of a tool on a job site that have different thicknesses of resilient sleeves is impractical logistically and is very expensive. What is needed in an expandable tool is a way to activate the exterior member be it a seal in the form of a resilient sleeve or a porous member to be subsequently used for passing or filtering fluid. The present invention provides this opportunity. It employs the progressive expansion of the mandrel to move a ring into the exterior member to compress it and increase its outer dimension. The ring is capable of being locked to the mandrel after being moved by the swage that moves within the mandrel. The ring can expand so as to not put the swage in a bind while still having a capability to latch to the mandrel to prevent the exterior member from snapping back in length at the conclusion of the expansion.

The invention can be compared to known techniques one of which is illustrated in U.S. Pat. No. 6,530,574 where the mandrel is pushed in to accommodate a sealing material on the exterior of the mandrel. The swage is passed through the mandrel pushing out the interior projection that initially allowed the sealing material to sit flush with the mandrel exterior wall for run in. By returning the inner dimension of the mandrel back to a cylindrical shape the sealing material is pushed radially outwardly into contact with a surrounding tubular. Other known art keeps packer sealing elements from extrusion when they are squeezed longitudinally by a setting sleeve device. This tool, shown in U.S. Pat. No. 6,203,020 does not involve mandrel expansion. Yet other designs simply use mandrel expansion to engage a seal on the exterior of a casing patch with a surrounding wellbore tubular. Some examples of this design are U.S. Pat. No. 6,622,789 and U.S. Applications 2003/0102127 and 2004/0016544.

Those skilled in the art will better understand the invention from the description of the preferred embodiment, the drawings and the claim, all of which appear below.

SUMMARY OF THE INVENTION

An expandable downhole tool features a mandrel that is expanded from within by a swage or other technique. The expansion of the mandrel advances an exterior ring or comparable slidably mounted object against an exterior sleeve that can be impervious or porous. The ring engages a ratchet mechanism to hold its position with respect to the mandrel as the swage advances through the mandrel and expands the ring and the exterior sleeve. The locking of the ring to the mandrel keeps the exterior sleeve from springing back longitudinally as the expansion is concluded.

DETAILED DESCRIPTION OF THE PREFERRED EMBODIMENT

Figure 1:
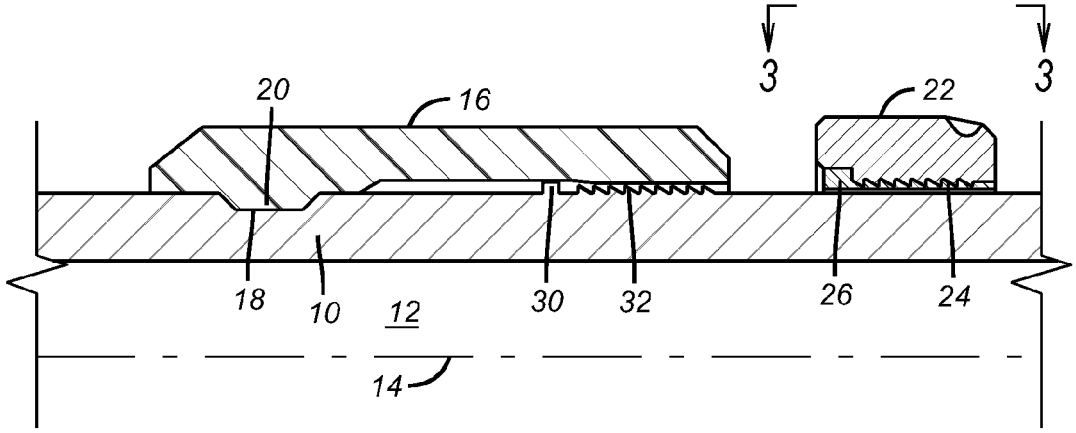
FIG. 1 is a section view of the run in position of the tool.

In a packer application of the present invention the mandrel 10 defines a passage 12 that runs along the longitudinal axis 14. A sleeve 16 is connected to mandrel 10. A recess 18 on the mandrel 10 accepts a protrusion 20 on the sleeve 16. A bonding agent (not shown) can be used in the recess 18 or/and elsewhere whether on the sleeve 16 or the portions of the mandrel 10 that it contacts. Preferably the sleeve 16 is rubber bonded to mandrel 10 but other materials that seal against a borehole wall or casing can be used in a packer application.

Figure 2:
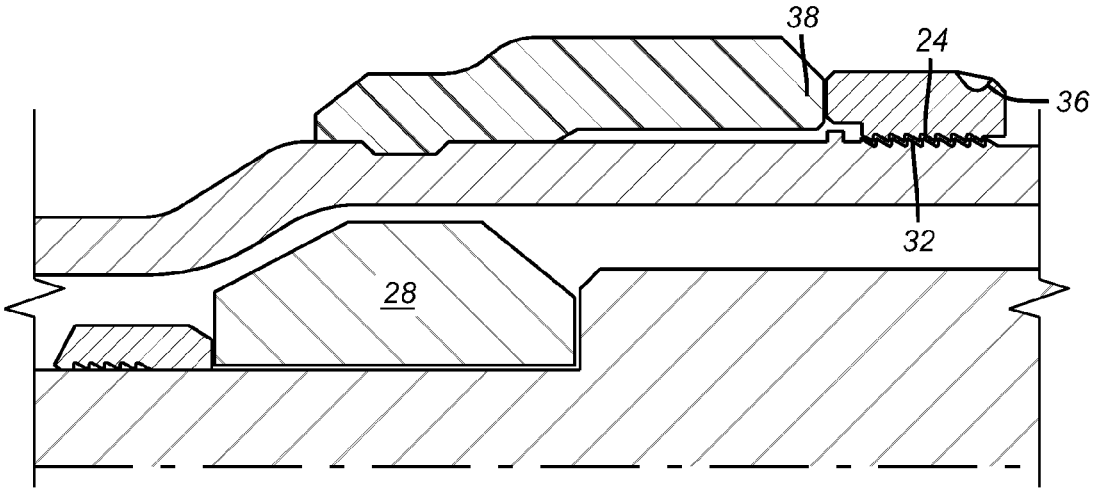
FIG. 2 is a section view of the set position of the tool.

As shown in FIG. 1, a ring 22 acts as a compaction element and is mounted onto mandrel 10 and further comprises a locking device that is preferably a series of protrusions or threads 24 that face mandrel 10. Optionally, a coating 26 or a lubricious material can be applied to the inside of the ring facing the mandrel 10. The coating or other form of lubrication helps the ring 22 move along mandrel 10 as the swage 28 is advanced in passage 12. Ring 22 is preferably split so as not to resist the advancement of the swage 28 by putting a significant hoop stress on the outside of mandrel 10. Mandrel 10 further features a travel stop 30 and a locking device, preferably threads 32 so that when the ring 22 is caused to advance by the movement of swage 28 it first abuts the sleeve 16 to longitudinally compress it, as shown in FIG. 2. Eventually the locking mechanisms 24 and 32 engage to keep the ring 22 from reversing direction after it hits the travel stop 30. With ring 22 on the travel stop 30 and movement of the swage 28 continuing, the ring 22 simply enlarges in diameter to let the swage 28 finish the expansion without undue resistance. The swage 28 is then withdrawn and the tool is in position. When it is a packer the sleeve 16 is impervious and because the ring 22 reduces the longitudinal length of sleeve 16 it necessarily increases its diameter beyond what would have already occurred due to the expansion with the swage 28. Not only that, but the locking feature of 24 engaging 32 holds that incremental force that further acts to increase the diameter of sleeve 16 while preventing it from springing back longitudinally from the force of ring 22 which due to expansion remains in a locked position.

Figure 3:
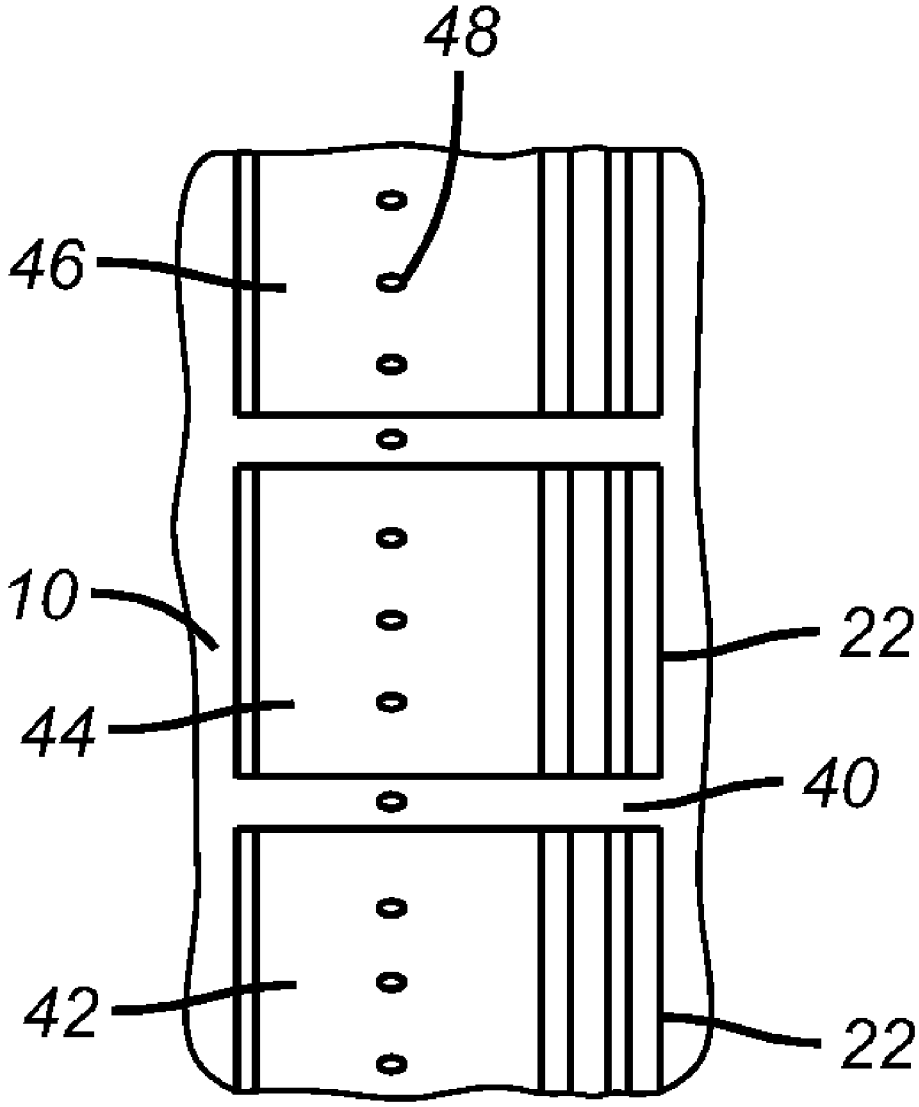
FIG. 3 is a plain view along line 3-3 of FIG. 1 showing the ring 22 as a split ring.

Ring 22 can be a C-ring with a single split 40 or it can be made of segments of which 42, 44 and 46, with both options illustrated in FIG. 3, that are retained together such as with a band spring schematically illustrated as 48. Those skilled in the art will appreciate that even though the mandrel 10 is expanded into a set position that it can be re-stretched after expansion for a release. A recess 36 can also be fitted on the ring 22 to allow a fishing tool to grip it and pull it so that the locking devices such as 24 and 32 fully disengage to allow the sleeve 16 to further elongate and thereby reduce its diameter to facilitate removal of the tool.

The tool offers the ability to employ an enhanced squeezing force for better wellbore contact. It also eliminates the need for matching thickness of sleeve 16 to the available swage or the anticipated well dimensions. The orientation of the sleeve 16 and the ring or other structure 22 that compresses the sleeve 16 can be reversed from that shown in the Figures if the direction of expansion is reversed. Preferably the end 38 closest to ring 22 is not secured to mandrel 10 and may actually optionally not even initially touch the mandrel 10 until after longitudinal compression.

The above description is illustrative of the preferred embodiment and many modifications may be made by those skilled in the art without departing from the invention whose scope is to be determined from the literal and equivalent scope of the claims below:

We claim:

1. A tool for wellbore use, comprising:

a mandrel having a longitudinal axis and defining a passage therethrough, said mandrel is capable of being expanded from said passage in a direction along said axis;

a sleeve mounted to said mandrel to expand therewith for contact with the surrounding wellbore;

a longitudinal compaction element initially spaced from said sleeve and slidably mounted on said mandrel for selective exclusive compressing on initial contact of said sleeve apart from said mandrel expansion, said compaction element continuously moved with a swage over a predetermined distance by progressing dimensional increase of said mandrel during its expansion to a locked position of said compaction element, whereupon, with said compaction element locked, said swage advances under said compaction element while enlarging said compaction element to continue expansion of said mandrel.

2. The tool of claim 1, wherein:

said compaction element is stopped in its advancement by a travel stop on said mandrel.

3. The tool of claim 1, wherein:

said sleeve is radially expanded by said compaction element while its length is reduced.

4. The tool of claim 1, wherein:

said sleeve is impervious;

5. The tool of claim 1, wherein:

adjacent contact surfaces between said compaction element and said mandrel are lubricated.

6. The tool of claim 1, wherein:

said compaction element comprises one of a split ring and segments flexibly retained together.

7. The tool of claim 1, wherein:

a pair of engaging threads lock said compaction element to said mandrel after initial movement of said compaction member.

8. The tool of claim 1, wherein:

said sleeve is at least in part attached to said mandrel near an end thereof remote from said compaction element.

9. The tool of claim 1, wherein:

said compaction element is stopped in its advancement by a travel stop on said mandrel;

said sleeve is radially expanded by said compaction element while its length is reduced;

adjacent contact surfaces between said compaction element and said mandrel are lubricated;

said compaction element comprises one of a split ring and segments flexibly retained together;

a pair of engaging threads lock said compaction element to said mandrel after initial movement of said compaction member.

10. The tool of claim 9, wherein:

said sleeve is at least in part attached to said mandrel near an end thereof remote from said compaction element.

11. The tool of claim 1, wherein:

said mandrel can be contracted by extension thereof to release said sleeve from contact with the wellbore.

12. The tool of claim 11, wherein:

said compaction element is locked into position after movement to compact said sleeve; and said compaction element comprises an attachment point for a pulling tool to move said compaction element to defeat said locked position after said mandrel has been extended.

* * * * *